United States Patent [19]

Kunimitsu et al.

[11] Patent Number: 4,812,063

[45] Date of Patent: Mar. 14, 1989

[54] BIDIRECTIONAL INK SHEET DRIVING MECHANISM IN A THERMAL TRANSFER PRINTER

[75] Inventors: Michio Kunimitsu, Yawata; Hiroshi Tomita, Kyoto, both of Japan

[73] Assignee: Sanyo Electric Ltd., Osaka, Japan

[21] Appl. No.: 169,076

[22] Filed: Mar. 16, 1988

Related U.S. Application Data

[63] Continuation of Ser. No. 897,193, Aug. 15, 1986, abandoned.

[30] Foreign Application Priority Data

Aug. 20, 1985 [JP] Japan ..... 60-182403

[51] Int. Cl.[4] ..... B41J 33/16

[52] U.S. Cl. ..... 400/234; 400/236.2; 400/240.3

[58] Field of Search ..... 400/120, 225, 234, 236, 400/236.1, 236.2, 240.3, 240.4, 618; 346/76 PH, 105; 242/75, 75.2, 75.4, 75.5, 75.51

[56] References Cited

U.S. PATENT DOCUMENTS

| | | | |
|---|---|---|---|
| 4,577,199 | 3/1986 | Saiki et al. | 400/240.3 |
| 4,611,937 | 9/1986 | Sato et al. | 400/234 |
| 4,660,053 | 4/1987 | Tsuturi et al. | 346/105 |

FOREIGN PATENT DOCUMENTS

| | | | |
|---|---|---|---|
| 2642881 | 3/1978 | Fed. Rep. of Germany | 400/236 |
| 58-140266 | 1/1983 | Japan . | |
| 190868 | 10/1984 | Japan | 400/234 |
| 116568 | 6/1986 | Japan | 400/234 |
| 120782 | 6/1986 | Japan | 400/234 |

*Primary Examiner*—David A. Wiecking
*Attorney, Agent, or Firm*—James D. Hall

[57] ABSTRACT

The thermal transfer printer of the present invention rotates a take-up roll and supply roll for an ink sheet by means of a first friction ring, which transmits the forward directed rotation of a driving motor for carrying the ink sheet to a take-up roll for the ink sheet by the friction force thereof when the ink sheet is carried in the forward direction and applies the brake power to the take-up roll for the ink sheet by frictional force thereof when the ink sheet is carried in the backward direction, and a second friction ring, which transmits the backwardly directed rotation of the driving motor to a supply roll for the ink sheet by the frictional force thereof when the ink sheet is carried in the backward direction and applies the brake power to the supply roll by the frictional force thereof when the ink sheet is carried in the forward direction. Accordingly, the ink sheet can be carried under the stabilized condition in both the forward direction and the backward direction, whereby the ink sheet, which is carried together with a recording paper in the initial position setting of the recording paper, can be rewound to use without wastefulness.

6 Claims, 8 Drawing Sheets

BIDIRECTIONAL INK SHEET DRIVING MECHANISM IN A THERMAL TRANSFER PRINTER

This is a continuation of application Ser. No. 897,193, filed on Aug. 15, 1986, now abandoned.

BACKGROUND OF THE INVENTION

1. Field of the Invention

This invention relates to a thermal transfer printer for color printing and, in particular, to a thermal transfer printer for color printing on a recording paper by using an ink sheet having sequential sections of ink of three primary colors or four colors including black. Each color is applied to a section of the ink sheet sequentially in segments equal to the length and width of a sheet of recording paper and the printer is programed to advance the ink sheet until the desired color reaches the print position.

2. Description of the Prior Art

A thermal transfer printer used as an output printer in the computer system, word-processor, and the like is readily capable of color printing by the application of ink of several different colors successively to the same page of the same printing medium. Such a printer can be used for outputting such data as displayed by the so-called computer graphics or to produce multi-color images.

A thermal transfer printer capable of color printing as described above has been disclosed in, for example, the Japanese Patent, Laid-open No. 58-140266 (1983).

In the thermal transfer printer such as above, generally, an ink sheet having sequential sections of ink in four colors including three primary colors (yellow, magenta, and cyan) and black and a recording paper are put one upon another and carried to a contact position between a thermal transfer head and the platen so that all colors of ink are thermally transferred to the recording paper in succession. Each time that printing in one color is completed, the recording paper is reversed, then brought forward and again printed in the succeeding color on the same page as that previously printed, the repeat of such process providing multi-color printing.

However, a thermal transfer printer of this type has a problem in that the recording paper and the ink sheet are transported together in the initial stage. When the machine is turned on, recording paper is fed until it reaches a sensor which is beyond the thermal transfer head a distance approximating a sheet of paper. The transfer is then retracted from contact with the platen and the machine is ready to print. The recording paper is relatively inexpensive, so this small amount of waste is not critical. The ink sheet, however, is very expensive and, since the ink sheet is transported with the recording paper, one of the colors advances past the transfer head. If that color is that which is programed to be printed, the ink sheet will be advanced until that color is again detected. As a consequence, four full ink faces can be, and usually are, wasted. This wastefulness is very expensive and most undesirable.

SUMMARY OF THE INVENTION

The present invention is intended to overcome the problem described above and it is a primary object of the present invention to provide a thermal transfer printer capable of efficiently using an ink sheet without wastefully consuming it. This is accomplished by reversing that portion of the ink sheet which is carried together with a recording paper without being used in the initial position setting, prior to the start of thermal transfer printing.

It is another object of the present invention to provide a thermal transfer printer capable of preventing the slackness or wrinkling of the ink sheet to by applying an optimum back tension to the ink sheet in both the case where the ink sheet is carried in the forward direction, and the case where the ink sheet is carried in the reverse direction.

It is still another object of the present invention to provide a thermal transfer printer, in which the carrying system for the ink sheet is constructed so that the ink sheet may be carried in both the forward direction and the reverse direction by means of one driving motor to achieve the above described objects in a simple construction.

The thermal transfer printer of this invention is characterized by comprising a supply roll for an ink sheet around which an ink sheet is wound; a take-up roll for winding the ink sheet therearound; a carrier roller positioned between said rolls for carrying the ink sheet in both a forward direction and a reverse direction; a holding reel for holding said take-up roll which is rotationally driven; a first friction member for transmitting the driving force thereof to said holding reel for said take-up roll by a frictional force thereof when the ink sheet is carried in the forward direction and applying a brake power to said holding reel for said take-up roll by a frictional force thereof so as to apply a back tension to the ink sheet when the ink sheet is carried in the reverse direction; a holding reel for holding said supply roll which is rotationally driven; and a second friction member for transmitting the driving force thereof to said holding reel for said supply roll by a frictional force thereof when the ink sheet is carried in the reverse direction and applying a brake power to said holding reel for said supply roll by a frictional force thereof so as to apply a back tension to the ink sheet when the ink sheet is carried in the forward direction.

The above and further objects and features of the invention will more fully be apparent from the following detailed description with accompanying drawings.

DESCRIPTION OF THE PREFERRED EMBODIMENT

A description of this invention will be made with reference to the drawings showing the preferred embodiment of this invention.

Figure 1:
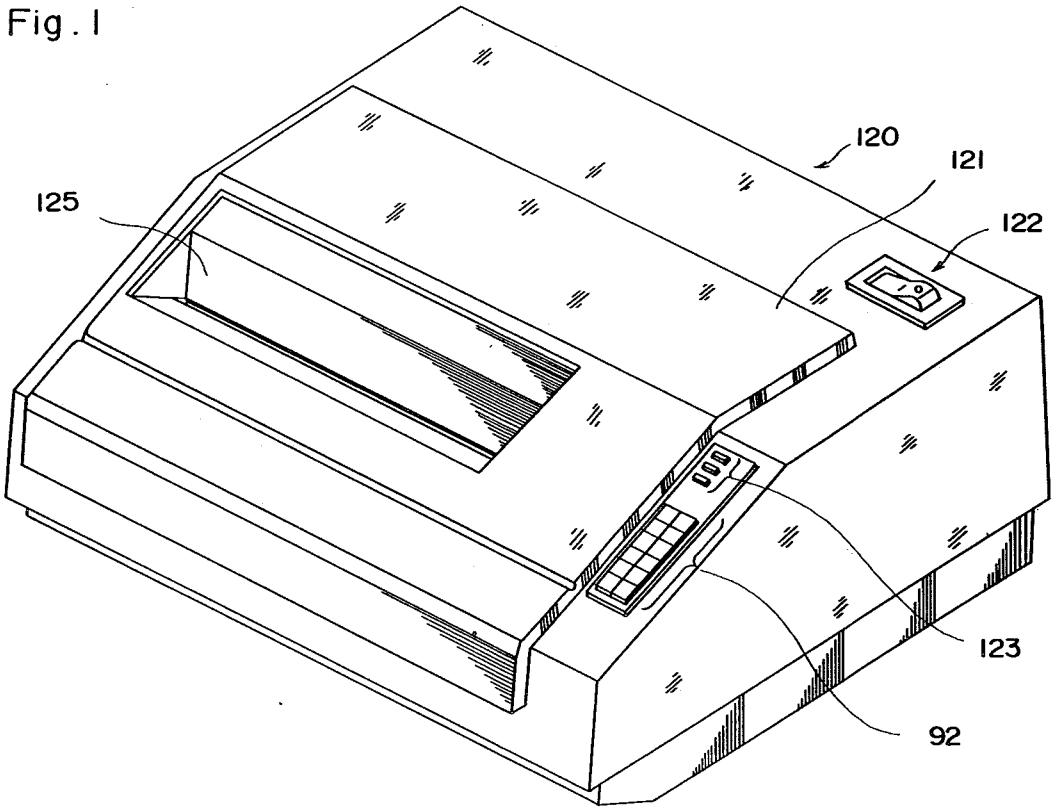
FIG. 1 is a perspective view showing the appearance of a thermal transfer printer of this invention.

FIG. 1 is a perspective view showing the appearance of a thermal transfer printer of this invention. Mechanical structural elements of the thermal transfer printer are contained in a roughly box-like casing 120. The printer is provided with a main switch 122 disposed on the upper rear end of the casing 120, an indication part 123 having various indicators, a key board 92 having various instruction keys disposed on the front right side, and a cover 121 for covering the central portions of the upper front sides throughout. On the upper surface of the cover 121, provided is an outlet 125 for the printed recording paper.

Figure 2:
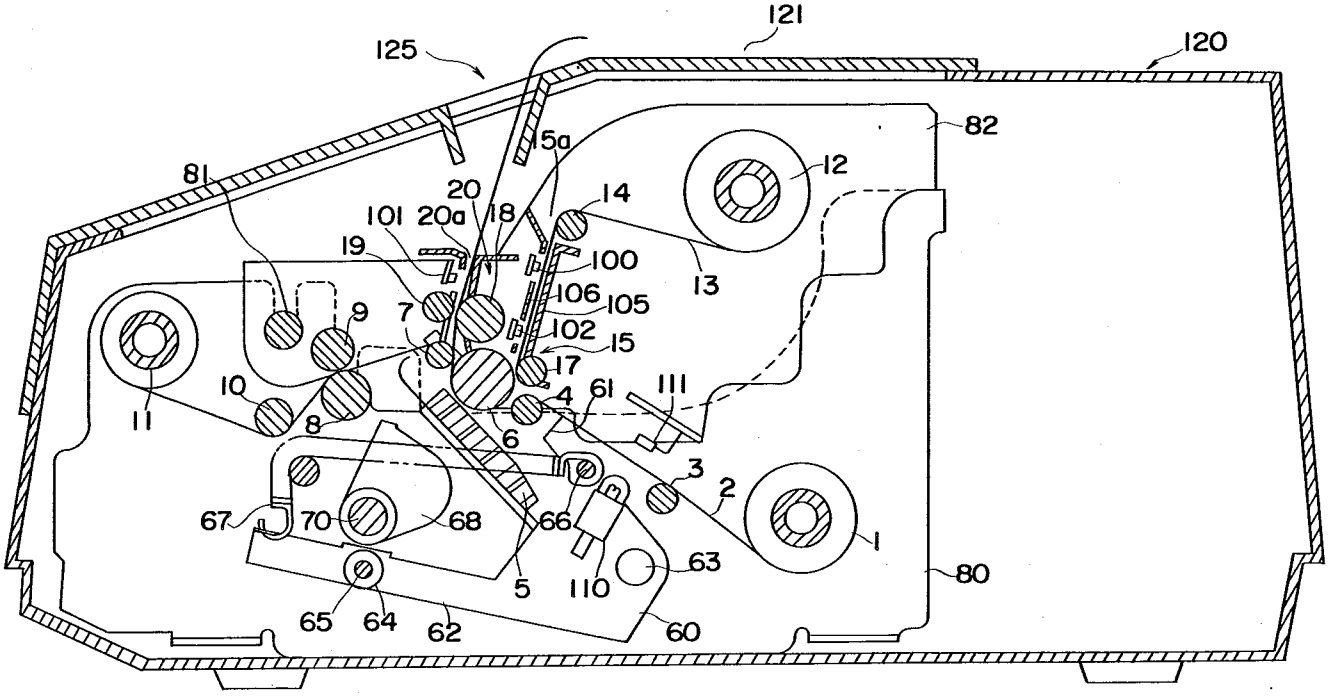
FIGS. 2 and 3 are sectional side views showing the mechanical structure thereof.
Figure 3:
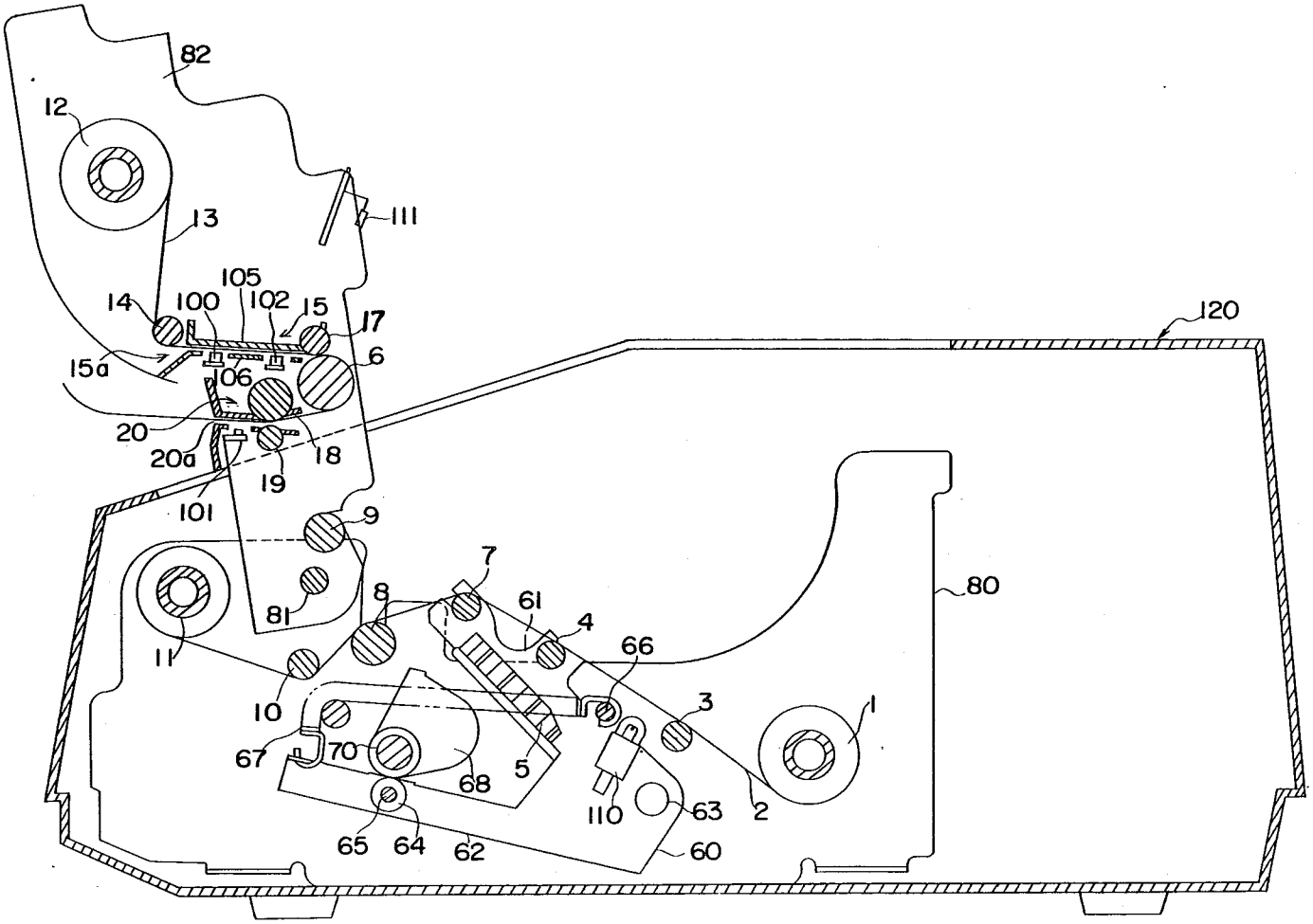

FIGS. 2 and 3 are sectional side views of a mechanical structure of the thermal transfer printer of this invention, showing a condition in which the thermal transfer head 5 and the platen 6 are pressed to each other and the other condition in which an upper part including the platen 6 is opened.

The main component members of this thermal transfer printer are fixed to a pair of stationary side plates 80 and 80 suitably fixed to the interior of the casing 120 upright on the right and left sides to be parallel with each other and also to a pair of movable side plates 82 and 82 lying above the stationary side plates 80 and 80 to be parallel with each other along the front-to-back direction (the direction of carrying the ink sheet 2 and the recording paper 13 as will be described later), being pivotally fixed to the stationary side plates 80 and 80.

Between the stationary side walls 80 and 80 and near the rear ends thereof (the right side on every drawing), is provided a supply roll 1 having the ink sheet 2 wound therearound; at the central parts of the stationary plates 80 and 80, a bracket 60 having the thermal transfer head 5 fixed thereto; at the front upper parts (the left side on every drawing), a take-up roll 11 for the ink sheet 2; in a position between the bracket 60 and the take-up roll 11, an ink sheet carrier roller 8 for carrying the ink sheet 2; and at the lower central parts of the stationary plates 80 and 80, a cam supporting shaft 70 which is fixed an eccentric cam 68 whose rotational center lies on a pivot of a segment. Further provided are: a guide shaft 3 for the ink sheet 2 and a first head guide shaft 4 between the ink sheet supply roll 1 and the platen 6; a second head guide shaft 7 between the platen 6 and the ink sheet carrier roller 8; and a guide shaft 10 between the ink sheet carrier roller 8 and the take-up roll 11.

The ink sheet carrier roller 8 is driven by an electric driving motor 30 as will be described later (see FIGS. 4 and 5). The rotational speed of roller 8 for carrying ink sheet 2 is synchronized with the carrying speed for the recording paper 13 as will be described later.

The movable side plates 82 and 82 are pivotally supported at one end thereof at an axis 81 of rotation provided on the front upper parts of the aforesaid stationary side plates 80 and 80. This permits the platen 6 and the thermal transfer head 5 to be pressed to each other with the other ends thereof turned backward in the normal state of operation. In other words, the movable side plates 82 and 82, when put into a state of use, are provided with: a recording paper roll 12 having the recording paper 13 wound therearound, disposed near the rear ends of the side plates (near the other ends of the casing 120); a slit-like sheet-inserting passage 15 formed by guide plates 105 and 106 depending almost vertically from the guide shaft 14 in the middle portion of a space interposed between the movable side plates 82 and 82; an upwardly directed recording paper discharging passage 20 formed by the second paper carrier roller 18 and the second pressing roller 19 facing each other so that the discharge passage is roughly parallel with the recording paper inserting passage 15; a platen 6 in the form of a roller further serving as a first recording paper carrier roller disposed between the lower end parts of the inserting passage 15 and of the discharging passage 20, as well as a first pressing roller 17; and another pressing roller 9 disposed slightly behind the axis of rotation 81 lying on the front side.

A pressing position of the first pressing roller 17 against the platen 6, serving as the first carrier roller, lines on the upstream side along the carrying direction for the recording paper above a contact position produced when the thermal transfer head 5 is pressed to the platen 6 (also a position of a line of heating elements of the thermal transfer head 5). Therefore, an acting position of carrying force exerted by the platen 6 as the first recording paper carrier roller upon the recording paper lies on the upstream side along the carrying direction for the recording paper 13 above the pressing position of the thermal transfer head 5 to the platen 6.

The upper end of the inserting passage 15 and that of the discharging passage 20 lead to an inlet opening **15*a* for the recording paper 13 undergoing change of running direction thereof at the guide shaft 14 and to an outlet 20*a* for discharging the recording paper 13 toward a discharging opening 125 of the cover 121 of the casing 120**, respectively.

A positional relation between parts to be arranged when the printer is in use (a state as shown in FIG. 2) is fixed so that the pressing roller 9 and the ink sheet carrier roller 8 on the side of the stationary side plates 80 and 80 are pressed to each other at the same time that the platen 6, as the first recording paper carrier roller, and the thermal transfer head 5 are pressed to each other.

A first sensor 100 is provided in a position relatively near the upper end (near insertion opening **15*a*) of the inserting passage 15; a third sensor 102, in a relatively lower position (near the platen 6) between the first sensor and the platen 6 in the insertion passage 15, and a second sensor 101, in a position relatively near the upper part (near discharging outlet 20*a*) of the discharging passage 20. The first and the second sensors 100 and 101 are photosensors for detecting as to whether the recording paper is present or not, and the third sensor 102 is a photosensor for detecting a mark indicating a printing start position impressed on the recording paper 13**.

The printing start position mark is used as a basis for setting a position from which printing with each color of the ink sheet 2 on the recording paper 13 is started.

A color sensor 111 is fixed to the movable side plates 82 and 82 at a position intermediate platen 6 and ink sheet supply roll 1. Further, a light source 110 for the color sensor 111 is fixed at the position of the plate brackets 60 and 60 opposite the color sensor 111 and interposed by the carrying passage for the ink sheet 2.

When the movable side plates 82 and 82 are turned counterclockwise around shaft 81 with the cover 121 removed as shown in FIG. 3 to be put into an open state, the ink sheet supply roll 1 and the ink sheet 2 are exposed to a wide open space above the casing 120 and the ink sheet supply roll 1 is readily inserted or replaced.

When the movable side plates 82 and 82 are turned as described above, the platen 6 is displaced from its position adjacent the thermal transfer head 5. However, clockwise rotation of the thermal transfer head 5 by the spring 67 around shaft 63 is prevented by the contact of lower branch parts 62 and 62 of the plate brackets 60 and 60 with cam supporting shaft 70. Accordingly, there is no possibility that the thermal transfer head 5 may be obstruct the movement of side plates 82 and 82.

Figure 4:
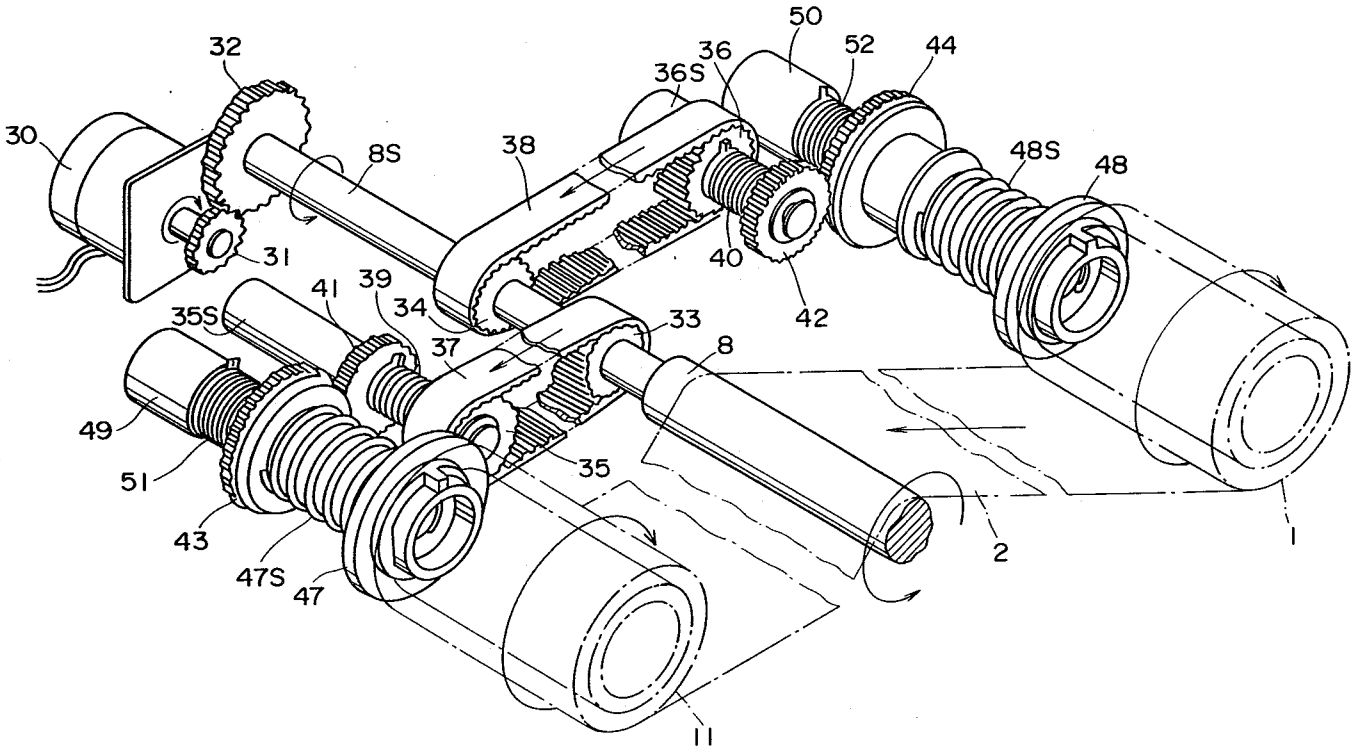
FIG. 4 is a perspective view of a fragmentary structure of carrying system for the ink sheet.
Figure 5:
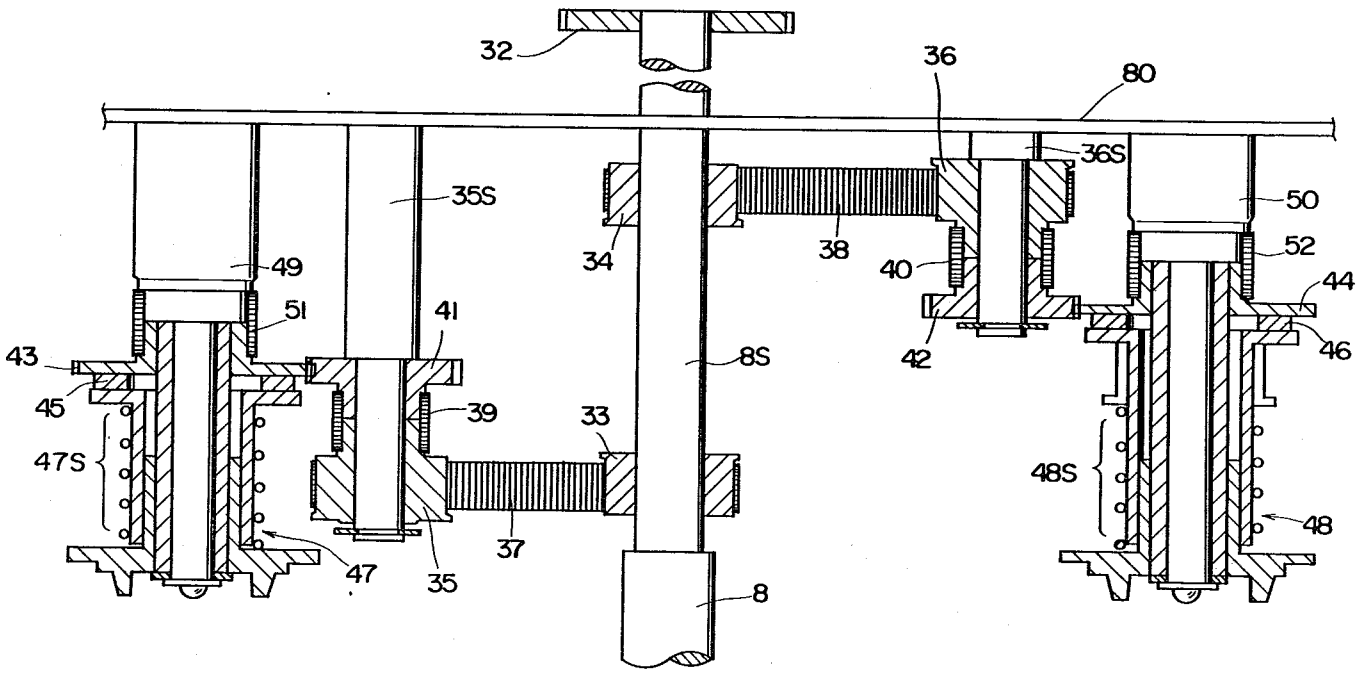
FIG. 5 is a plan view thereof.

FIGS. 4 and 5 are a fragmentary perspective view and a plan view, respectively, of a main parts composing a carrying system for the ink sheet 2.

The selectric driving motor 30 used in this printer is a pulse motor capable of rotating in either direction and mounted with a spur gear 31 at the output shaft. The spur gear 31 meshes with another spur gear 32 fixed to a shaft 8S pivoted by the stationary side plates 80 and 80. The shaft 8S is mounted with spur gears 34 and 33 disposed in succession from a position near the spur gear 32 and a part thereof closer to the front end is formed of a larger diameter to work as an ink sheet carrier roller 8.

A cogged belt 37 having teeth corrugated on its inner periphery is extended between the spur gear 33 and an idler gear 35 idly mounted on a shaft 35S fixed to the side plate 80 and spaced from the shaft 8S at an appropriate distance. Another similar cogged belt 38 is extended between the spur gear 34 and an idler gear 36 idly mounted on a shaft 36S fixed to the side plate 80 and spaced from the shaft 8S at an appropriate distance. The idler gear 35 is connected to an idler gear 41 idly mounted on the shaft common thereto through a spring clutch 39. Another idler gear 36 is connected to an idler gear 42 idly mounted on the shaft common thereto through a spring clutch 40.

The spring clutch 39 transmits rotation of the idler gear 35 to the idler gear 41 only when the idler gear 35 turns counterclockwise on FIG. 4. The spring clutch 40 transmits rotation of the idler gear 36 to the idler gear 42 only when the idler gear 36 turns clockwise on FIG. 4.

The idler gears 41 and 42 mesh with idler gears 43 and 44 idly fitted onto shafts 49 and 50 fixed to stationary side plates 80 and spaced at appropriate distances from shafts 35S and 36S, respectively.

The idler gears 43 and 44 are provided with spring clutches 51 and 52 on the root sides of shafts 49 and 50, respectively. The spring clutch 51 operates for intercepting rotation of the idler gear 43 in the counterclockwise direction on FIG. 4 whereas another spring clutch 52 operates for intercepting rotation of the idler gear 44 in the clockwise direction.

Friction rings 45 and 46 as well as holding reels 47 and 48 for the ink sheet take-up roll 11 and for the ink sheet supply roll 1, respectively, are idly fitted on the front end sides of the idler gears 43 and 44 on the end parts of the shafts 49 and 50, respectively. Both reels 47 and 48 press the friction rings 45 and 46 toward the idler gears 43 and 44 by means of coiled springs 47S and 48S provided for both reels, respectively.

Performance of the driving system thus constructed for the carrying of the ink sheet 2 is as follows:

With the rotation of the driving motor 30 in the forward direction (clockwise as indicated by the arrow in FIG. 4), the ink sheet carrier roller 8 rotates counterclockwise and cogged belts 37 and 38 run counterclockwise. Running of the cogged belt 37 is transmitted from the idler gear 35 to the idler gear 41 and further to another idler gear 43 through the spring clutch 39. Running of the cogged belt 38 is not transmitted from the idler gear 36 to another idler gear 42 because spring clutch 40 is kept out of engagement. Therefore, the ink sheet 2 is carried from the right to the left on FIG. 4 (hereinafter called "forward carrying direction") by rotation of the ink sheet carrier roller 8 in a counterclockwise direction as shown on FIG. 4. At this time, however, since the spring clutch 40 is out of engagement and the driving power of the driving motor 30 is not transmitted to the side of the ink sheet supply roll 1, the ink sheet 2 is drawn from the ink sheet supply roll 1 and wound around the ink sheet take-up roll 11 with rotation of the take-up roll holding reel 47 to which the driving power of the driving motor 30 is transmitted.

In the abovesaid performance, the idler gear 44 on the side of the ink sheet supply roll holding reel 48 is prevented from rotating by the spring clutch 52. The friction ring 46 is interposed between the idler gear 44 and the ink sheet supply roll holding reel 48. Accordingly, when the ink sheet 2 is drawn from the ink sheet supply roll holding reel 48, braking force, that is, frictional force of the friction ring 46, acts upon this reel 48. Consequently, when the ink sheet 2 is drawn from the ink sheet supply roll 1 to the side of the take-up roll 11, backward tension is exerted upon the ink sheet 2 from the side of the ink sheet supply roll 1 and the ink sheet 2 is less likely to slacken or wrinkle.

As has been made apparent from the foregoing, the driving system for carrying the ink sheet 2 is symmetrical with respect to the ink sheet carrier roller 8 and, therefore, it will readily be understood that the ink sheet 2 is carried in the direction opposite to that described above when the driving motor 30 rotates in the opposite direction (counterclockwise on FIG. 4), while braking force of the friction ring 45 acts upon the take-up roller holding reel 47 so as not to cause the ink sheet 2 to slacken or wrinkle.

As described above, in the driving system for carrying the ink sheet 2 in this embodiment, the ink sheet 2 is carried in either direction by rotation of a single driving motor 30 rotating in either direction, being free from any possibility of slackening or wrinkling when being carried in any direction.

It will be understood that it is possible to employ a structure being provided with a plurality of driving motors rotating in a single direction each independently used depending on the direction for carrying the recording paper 13, or another structure being provided with driving motors each exclusively used for driving the respective parts as the ink sheet carrier roller 8, take-up roll holding reel 47, and ink sheet supply roll holding reel 48 without departing from the scope of the invention.

The, structure around thermal transfer head 5 of the printer of this invention, particularly, a structure for adapting the printing head 5 to be pressed or to be released from the platen 6 is fully described in our co-pending application Ser. No. 897,110, and will not be described here.

The, control operation conducted by the control unit 90 is fully described in our co-pending U.S. application Ser. No. 897,382 and will not be described here.

Figure 6:
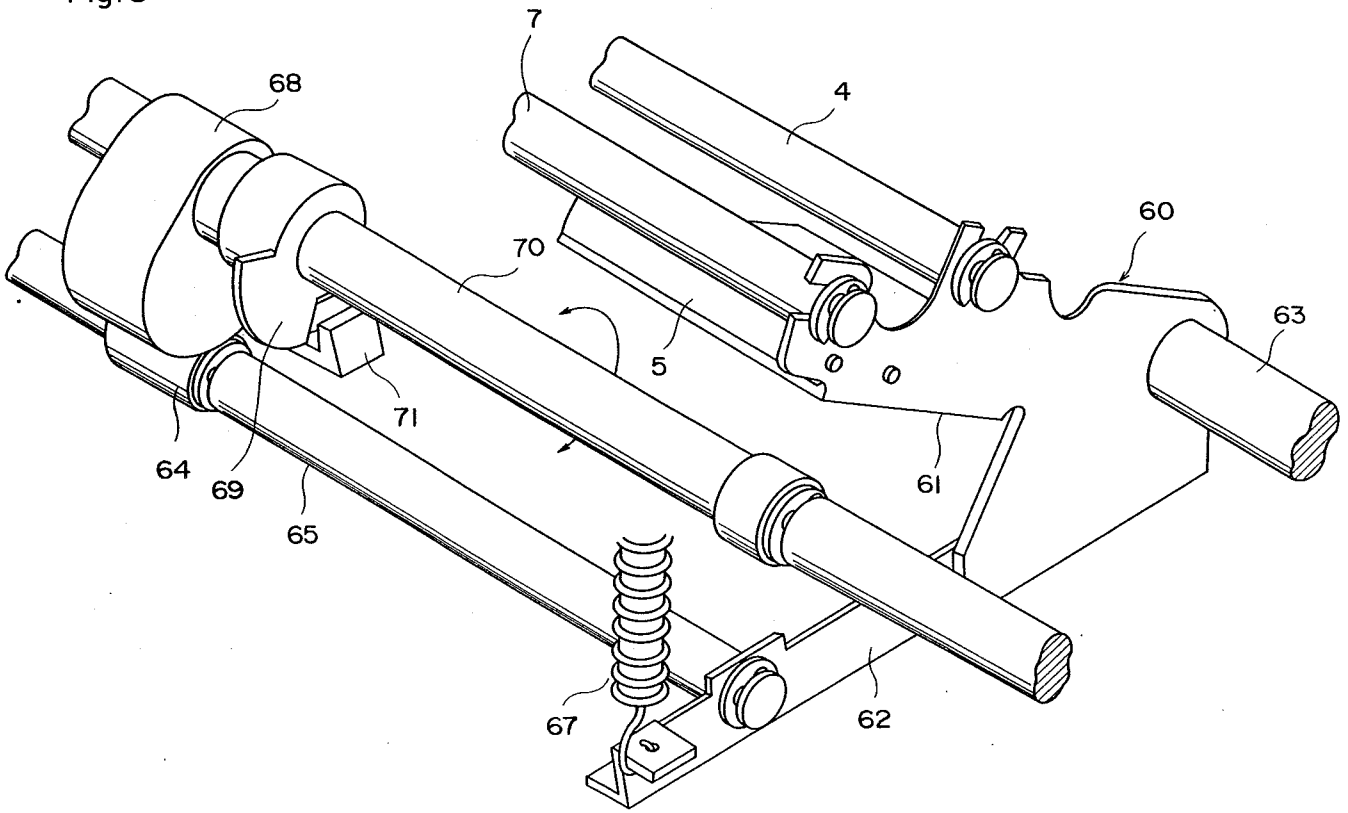
FIG. 6 is a flow chart showing the control sequence for initialization of position of the recording paper by means of the control unit.

Control for initial position setting of the recording paper 13 by means of the control unit 90 will be described with reference to a flow chart in FIG. 6.

When the eccentric cam 68 is not being set in the first position, the control unit 90 sets the eccentric cam 68 in the first position depending on the abovesaid control (step S31) to keep the thermal transfer head 5 pressed to the platen 6.

When the recording paper 13 is drawn from the recording paper roll 12 by the operator and the foremost end thereof is inserted into the printer through the insertion opening 15*a* and positioned on the contact part between the platen 6 as the first paper carrier roller and the first pressing roller 17, the first sensor 100 detects the recording paper 13 and outputs a predetermined signal "1" to the control unit 90 (step S32). In the case where the first sensor 100 detects absence of the recording paper 13, an indication as "paper out" is displayed on the indication part 123 of the casing 120 (step S38).

When a recording paper carrier switch placed on the key board 92 is turned on while only the first sensor detects the recording paper 13 (step S34), the platen 6 and the paper carrier roller 18 are driven clockwise respectively. Thus, the recording paper 13 is carried from the contact part between the platen 6 and the first pressing roller 17 to another contact part between the platen 6 and the thermal transfer head 5 and further to still another contact part between the paper carrier roller 18 and the second pressing roller 19 (step S35) until the second sensor 101 detects the recording paper 13 and outputs a signal "1" (step S33).

In this way, the recording paper 13 is further carried after the foremost end thereof is detected by the second sensor 101 (step S34). When the detection signal "1" is outputted to the control unit 90 (step S36) with detection of a printing start position mark impressed on the recording paper 13 by the third sensor 102, the control unit 90 further carries the recording paper 13 by a predetermined length (step S37) so as to bring the actual printing start position on the recording paper into adjustment with a printing position of the thermal transfer head 5.

Since initial position setting for the recording paper 13 as above is performed in a state that the thermal transfer head 5 is pressed to the platen 6, that is, the eccentric cam 68 is set in the first position, so the ink sheet 2 is also carried in the forward direction by the same length as that of the recording paper 13. Therefore, if the above state continues as it is, a length of the ink sheet 2 carried during initial position setting of the recording paper 13 is useless and, in view of this drawback, rewinding of the ink sheet 2 in the thermal transfer printer of this invention is so designed as to be performed at the time of position adjustment of the ink sheet 2.

Figure 7:
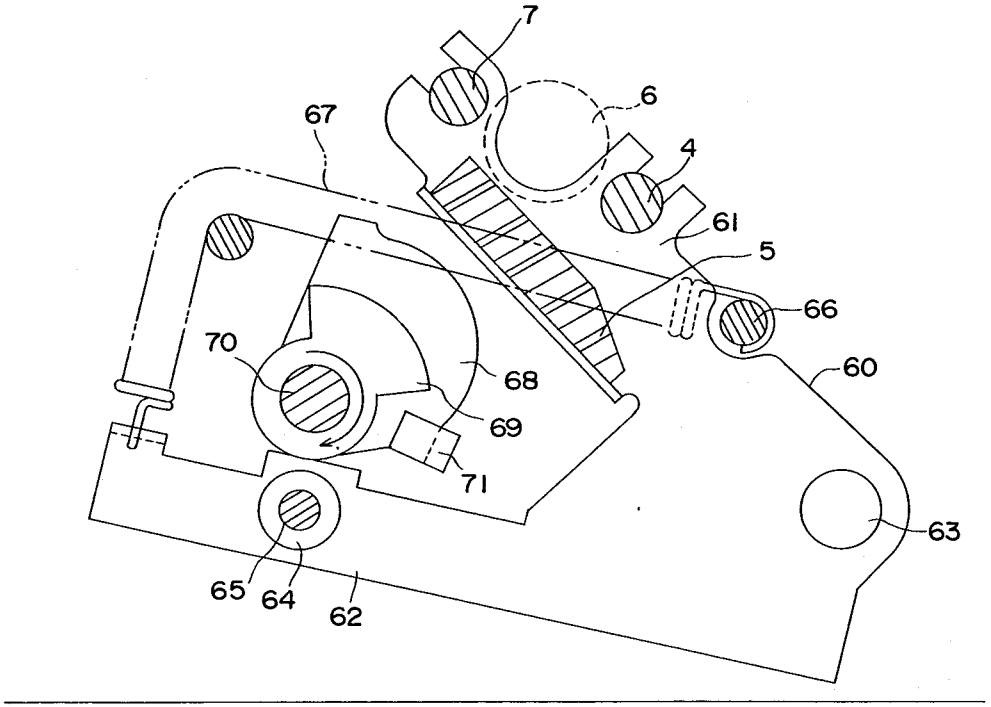
FIG. 7 is a flow chart showing the control sequence for adjustment of position of the ink sheet by means of the control unit.

FIG. 7 is a flow chart showing a sequence of the control unit 90 in position adjustment of the ink sheet 2.

Position adjustment of the ink sheet 2 is to bring the foremost end of each section of ink sheet 2 having four colors as yellow:Y, magenta:M, cyan:C, and black:B face sequentially into exact adjustment with respective printing positions (positions for line of heating elements of the thermal transfer head 5). Position adjustment of the ink sheet 2 is carried out in an initial state immediately after turning-on of the power source and prior to printing with a section in one color following the finish of printing in with the preceding color.

Control of position adjustment of the ink sheet 2 is performed by the control unit 90 on the basis of a detection signal obtained from the color sensor 111 which detects light rays passing through the ink sheet 2 emitted from the light source 110 disposed to face the sensor 111 with the carrying passage for the ink sheet 2 interposed therebetween. As a color sensor for the use as above, for example, an amorphous integrated full color sensor as disclosed in the Japanese Patent, Laid-Open No. 58-125865 (1983) is suitable. The color sensor disclosed therein is so composed as to provide three bits of signals in response to the color of light received thereby.

For position adjustment of the ink sheet 2, the control unit first performs control for setting the eccentric cam 68 in the second position to release the thermal transfer head 5 from the platen 6 (step S41). Since the ink sheet 2 is carried in the forward direction by a length equal to that of the recording paper carried at the time of initial position setting of the recording paper 13, the control unit 90 performs control to drive the driving motor 30 in the opposite direction and to carry the ink sheet 2 in the opposite direction by a length as described above (step S42).

The control unit 90 then turns on the light source 110 (step S43). At this time, if the required color (yellow at the time of initial setting) is detected, the control unit 90 drives the driving motor 30 to carry the ink sheet 2 step by step in the forward direction until the color is not detected (steps S44 and S45). Afterward, the control unit 90 drives the driving motor 30 to carry the ink sheet 2 step by step in the forward direction until the required color is again detected (steps S46 and S47). When the required color is detected at step S45 as above, the detected position is not proved to be the foremost end position of a section having the required color, however, since the other color is detected afterward and the other section having the other color is carried in the forward direction until the required color is again detected, the foremost end position of the section having the required color is substantially detected.

Subsequently, the control unit 90 turns off the light source 110 (step S48) and completes the process of position adjustment of the ink sheet 2.

When the recording paper 13 and the ink sheet 2 are separately subjected to initial position adjustment as above, the control unit 90 performs control to set the eccentric cam 68 in the first position so that the thermal transfer head 5 presses to the platen 6, and carries the recording paper 13 and the ink sheet 2 while synchronizing carrying speeds for the ink sheet 2 and recording paper 13. In such a state as above, control over heat generation at a line of heating elements of the thermal transfer head 5 provides thermal transfer printing with one color, for example, yellow.

Figure 8:
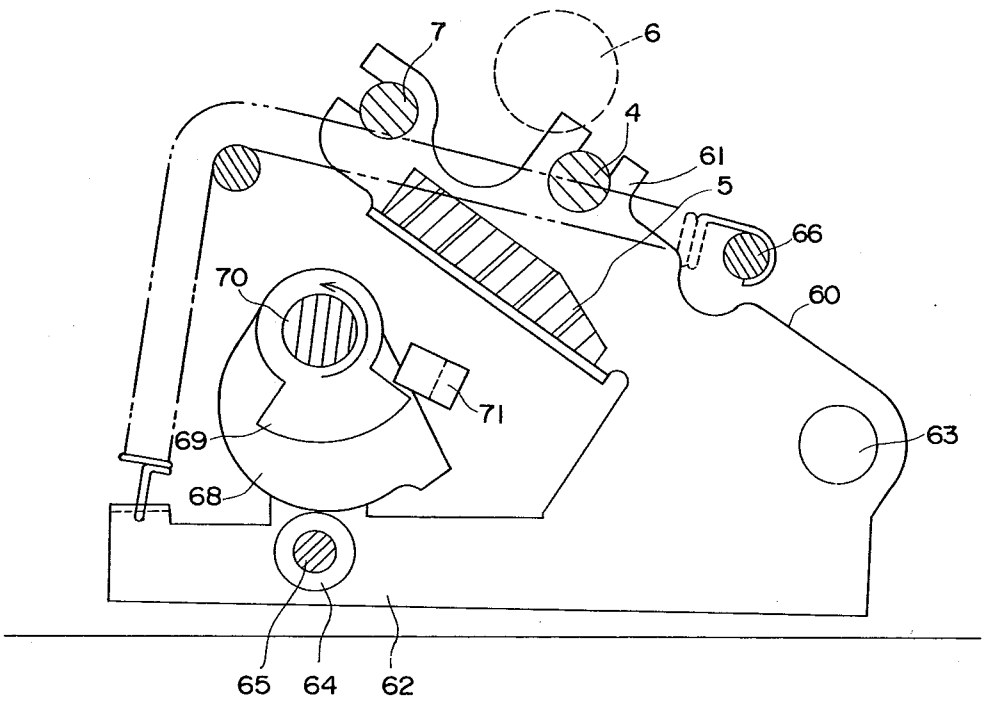
FIG. 8 is a flow chart showing the control sequence for backward carrying of the recording paper by means of the control unit after completing the printing with one color.
Figure 9:
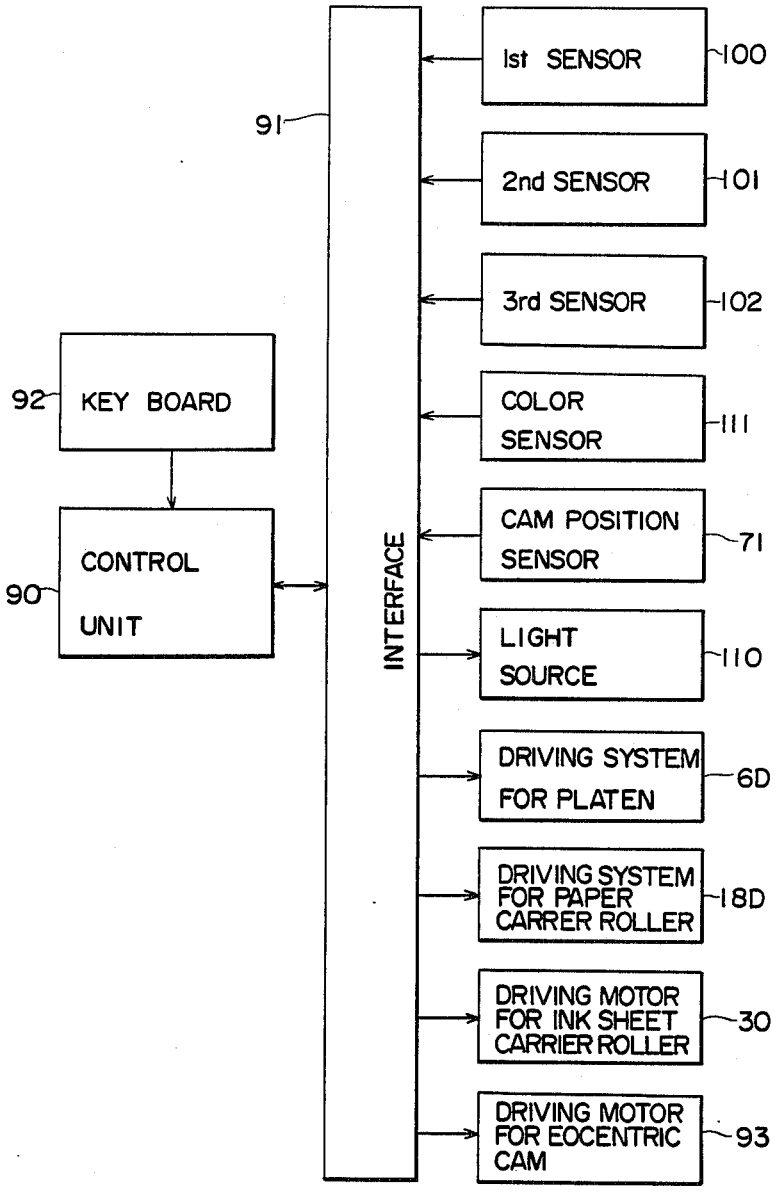
Figure 10:
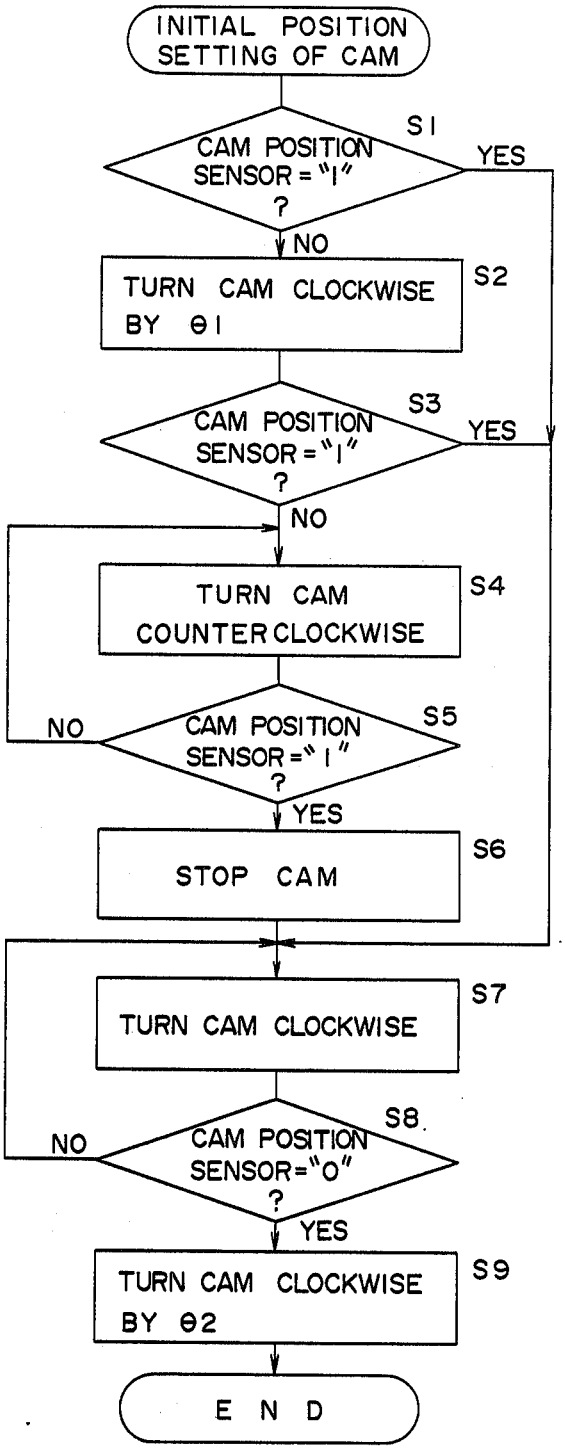
Figure 11A:
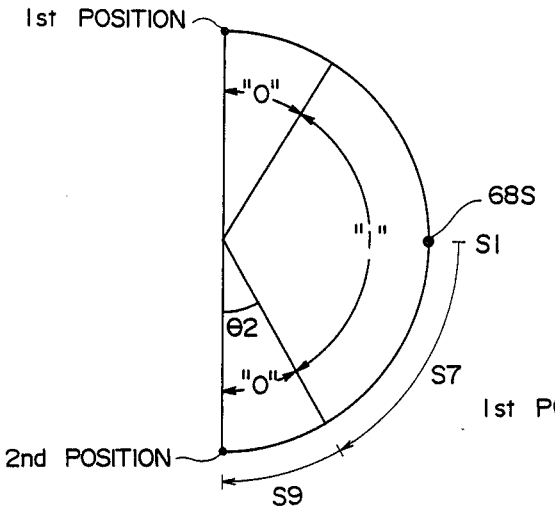
Figure 11B:
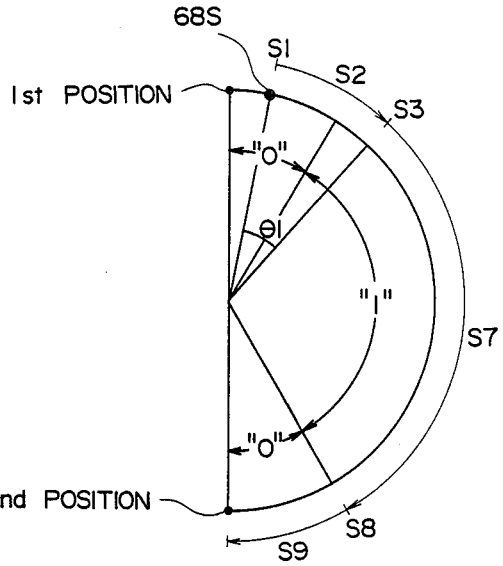
Figure 11C:
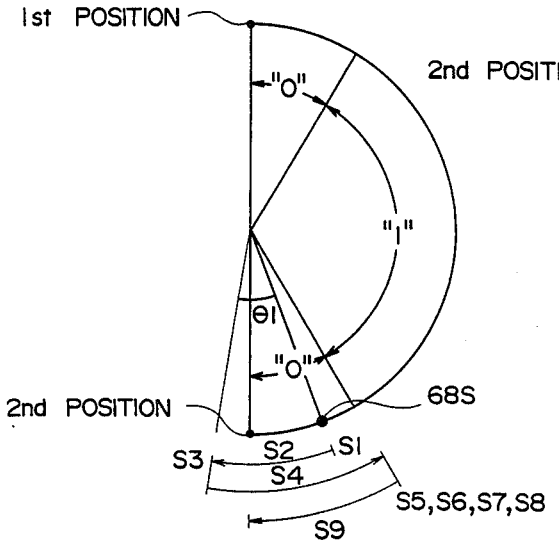
Figure 12:
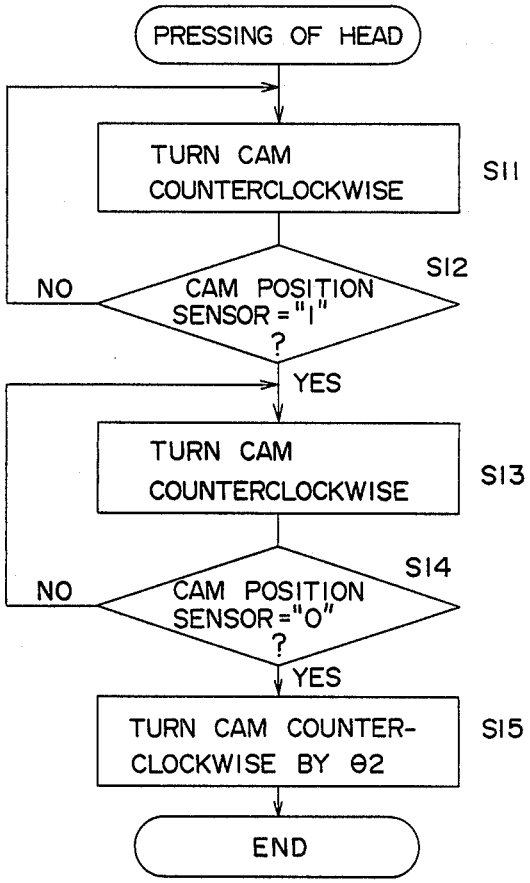
Figure 13:
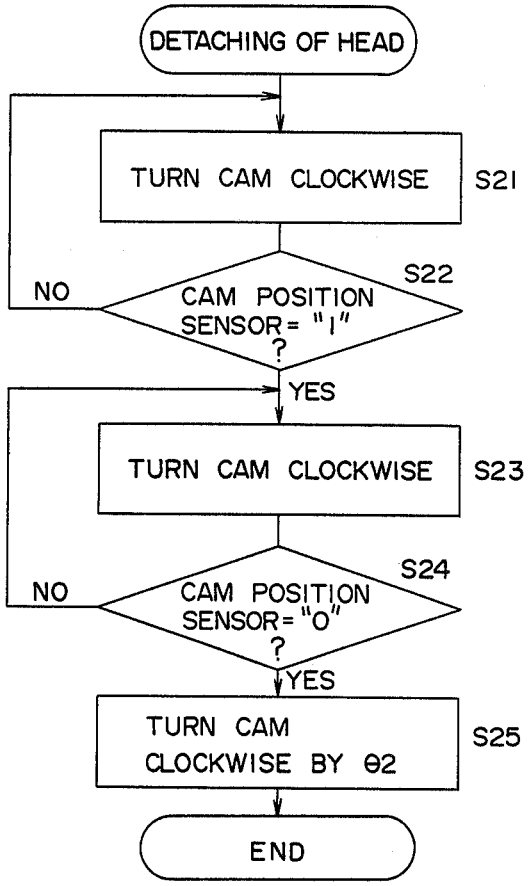
Figure 14:
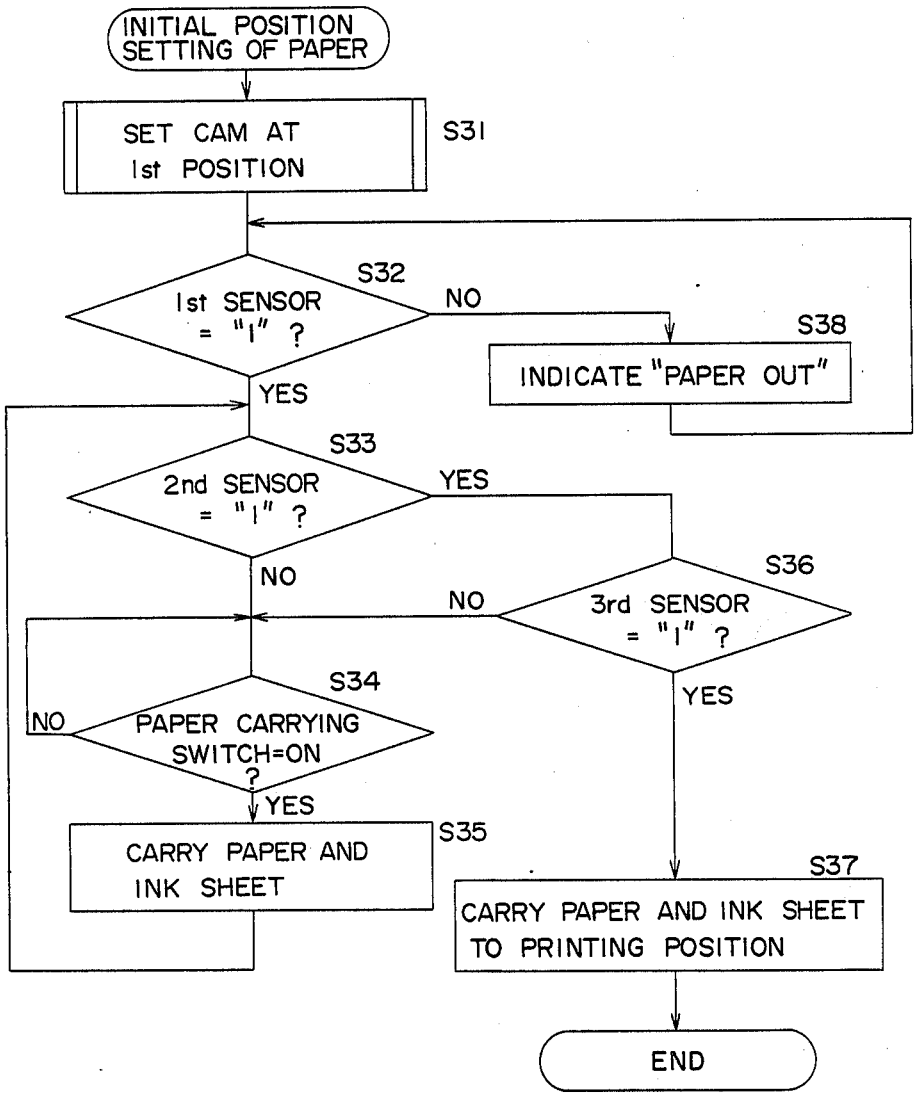
Figure 15:
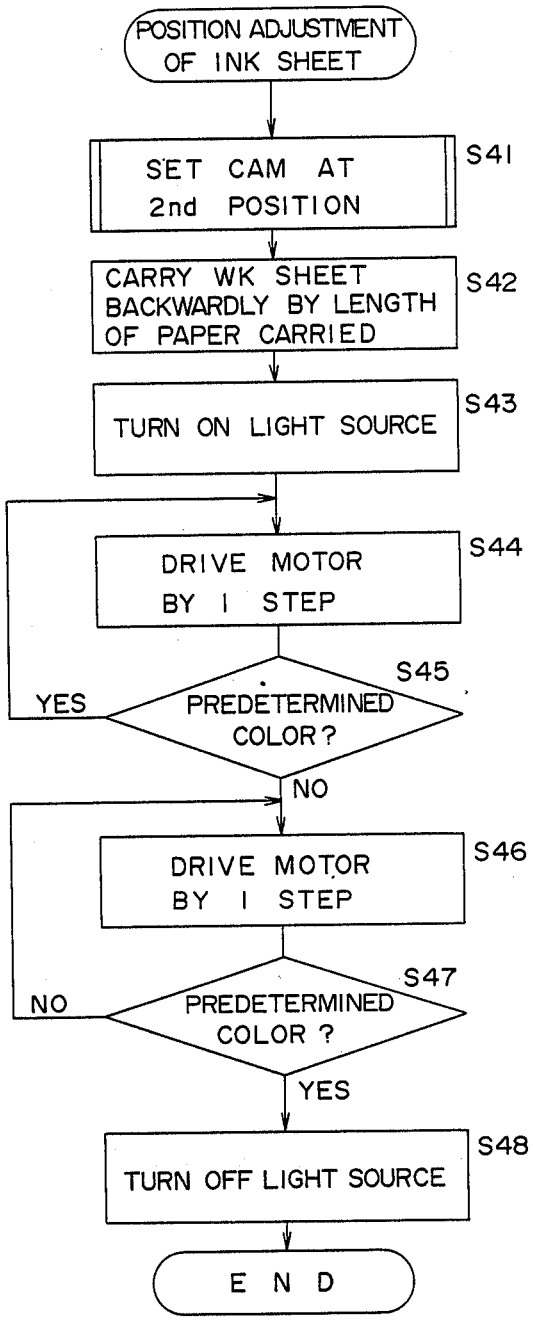
Figure 16:
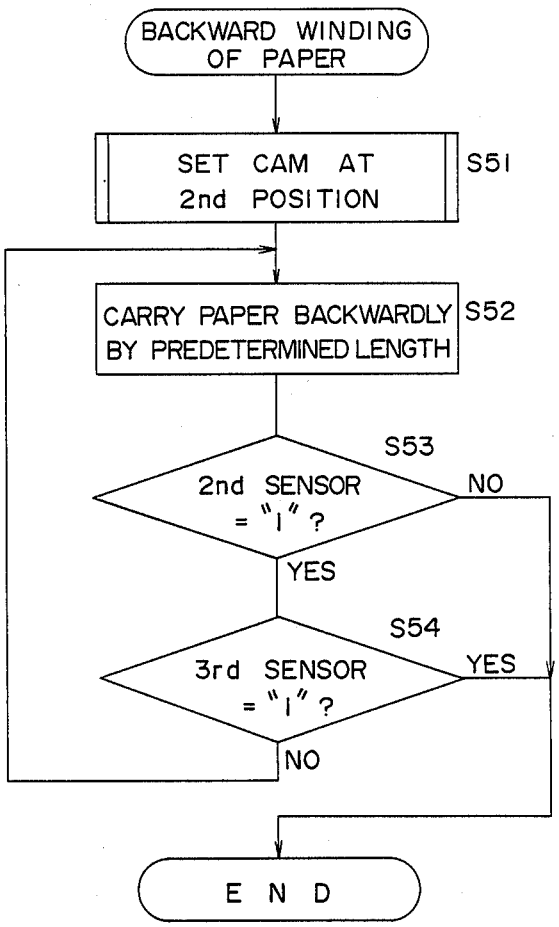

Subsequently to the completion of thermal transfer printing in yellow ink as a first-color ink, the recording paper 13 is rewound. FIG. 8 is a flow chart showing a sequence of control over rewinding of the recording paper 13 by means of the control unit 90

The control unit 90 operates to release the thermal transfer head 5 from the platen 6 (to set the eccentric cam 68 in the second position) (step S51). The control unit 90 then rewinds the recording paper 13 step by step, that is, carries the recording paper 13 in the reverse direction (steps S52, S53, and S54) until the foremost end of the recording paper 13 is detected by the second sensor 101, that is, the foremost end of the recording paper 13 is carried to the side of the platen 6 beyond the detecting position for the second sensor 101, or the printing start position mark on the recording paper 13 is detected by the third sensor 102. Usually, the printing start position mark on the recording paper 13 is first detected by the third sensor 102 through the above-said process and, therefore, initial position setting of the recording paper 13 is possible after the abovesaid detection.

In the result that the printing start position mark cannot be detected by the third sensor 102 for some reasons during the carrying of the recording paper 13 in the reverse direction, detection of the foremost end of the recording paper 13 by the second sensor 101 prevents the foremost end of the recording paper 13 from being carried in the reverse direction beyond the control part between the paper carrier roller 18 and the second pressing roller 19. Accordingly, excessive rewinding of the recording paper 13 to slip off the contact part between the paper carrier roller 18 and the second pressing roller 19 is prevented. Even in such a case as excessive rewinding of the recording paper 13, initial position setting as described above can be performed accurately.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within the metes and bounds of the claims, or equivalents of such metes and bounds thereof, are therefore intended to be embraced by the claims.

What is claimed is:

1. A thermal transfer multi-color line printer wherein recording paper is imprinted from an ink sheet having a plurality of color frames, the recording paper is overlapped on one color frame of the ink sheet, carried forward with the ink sheet for initial setting and printed by a thermal head while being carried forward, and the recording paper is carried in a reverse direction after said printing from said color frame and overlapped on another color frame of the ink sheet for a next printing, comprising a supply roll for an ink sheet around which an unsued portion of said ink sheet is wound;

a take up roll for winding a used portion of said ink sheet therearound;

a carrier roller positioned between both rolls for carrying the ink sheet in both the forward and the reverse direction;

a motor for applying a rotational driving force to the carrier roller;

a first holding reel for holding said take up roll which is rotationally driven;

a first shaft located between said carrier roller and said take up roll;

a first rotating member and a second rotating member supported by said first shaft and provided with a one-way clutch therebetween, and the first rotating member being driven by the rotation of said carrier roller and the one-way clutch transmitting the rotational driving power to the second rotating members when the ink sheet is carried in the forward direction;

a third rotating member being driven by the second rotating member, being fitted to a second shaft which supports said holding reel for said take up roll with a one-way clutch on said second shaft that prohibits the rotation of said first holding reel when the ink sheet is carried in the reverse direction;

a first friction member, which is fitted to the second shaft and disposed between said first holding reel for said take up roll and the third rotating member, for transmitting the rotational driving force of said first friction member from the third rotating member to said first holding reel for said take up roll by a frictional force thereof when the ink sheet is carried in the forward direction and applying a brake power to first said holding reel for said take up roll by a frictional force thereof so as to apply a back tension to the ink sheet when the ink sheet is carried in the reverse direction and rotationally drives the take up roll;

a second holding reel for holding said supply roll which is rotationally driven;

a third shaft located between said carrier roller and said supply roll;

a fourth rotating member and a fifth rotating member supported by said third shaft and provided with a one-way clutch therebetween, and the fourth rotating member being driven by the rotation of said carrier roller and the one-way clutch transmitting the rotational driving power to the fifth rotating member when the ink sheet is carried in the reverse direction;

a sixth rotating member being driven by the fifth rotating member, being fitted to a fourth shaft which supports said second holding reel for said supply roll with a one-way clutch on said fourth shaft that prohibits the rotation of said second holding reel when the ink sheet is carried in the forward direction; and a second friction member, which is fitted to the fourth shaft and disposed between said second holding reel for said supply roll and the sixth rotating member, for transmitting the rotational driving force of said second friction member from the sixth rotating member to said second holding reel for said supply roll by a frictional force, when the ink sheet is carried in the reverse direction and applying a brake power to said holding second reel for said supply roll by a frictional force thereof so as to apply a back tension to the ink sheet when the ink sheet is carried in the forward direction to rotationally drive the supply roll.

2. A thermal transfer multi-color printer as set forth in claim 1 wherein the first shaft is supported at one end thereof.

3. A thermal transfer multi-color printer as set forth in claim 1 wherein the third shaft is supported at one end thereof.

4. A thermal transfer multi-color printer as set forth in claim 1 wherein said rotating members are gears.

5. A thermal transfer multi-color printer as set forth in claim 1 wherein said first rotating members provided at the first shaft is driven by a belt driven by the carrier roller.

6. A thermal transfer multi-color printer set forth in claim 1 wherein said fourth rotating members provided at the third shaft is driven by a belt driven by the carrier roller.

* * * * *